United States Patent [19]

Howard

[11] 4,251,039

[45] Feb. 17, 1981

[54] ROLLING DOOR CURTAIN MOUNTING APPARATUS

[76] Inventor: Douglas Howard, 10256 S. Choctaw, Baton Rouge, La. 70815

[21] Appl. No.: 61,710

[22] Filed: Jul. 30, 1979

[51] Int. Cl.[3] ..... B65H 17/02; B65H 75/40

[52] U.S. Cl. ..... 242/86.52; 242/67.3 R; 242/68.7

[58] Field of Search ..... 242/86.52, 86.5 R, 85, 242/67.3 R, 68.7, 78.7, 55, 67.1 R

[56] References Cited

U.S. PATENT DOCUMENTS

| | | | |
|---|---|---|---|
| 2,656,050 | 10/1953 | Best et al. | 242/68.7 |
| 3,325,120 | 6/1967 | Brinkman | 242/86.52 |
| 3,408,018 | 10/1968 | Best | 242/68.7 X |
| 3,501,109 | 3/1970 | Edson | 242/86.52 |
| 3,889,831 | 6/1975 | Davis | 242/68.7 X |
| 3,982,711 | 9/1976 | Bradley et al. | 242/68.7 X |
| 4,153,221 | 5/1979 | Howard | 242/86.52 |

*Primary Examiner*—John M. Jillions

*Attorney, Agent, or Firm*—Roy, Kiesel, Patterson & McKay

[57] ABSTRACT

An apparatus for mounting a rolling door curtain on a barrel assembly, which will be attached in position about an opening that the rolling door curtain will close, is disclosed comprising a movable carrier having drive means attached thereto in one position with rolling door curtain support braces attached to the movable carrier below the drive means wherein the barrel assembly is removably attached to the drive means and rotatably attached to the movable carrier.

4 Claims, 5 Drawing Figures

ROLLING DOOR CURTAIN MOUNTING APPARATUS

BACKGROUND OF THE INVENTION

1. Field of the Invention

This invention relates generally to rolling doors, and more particularly to apparatus for mounting a rolling door curtain on a barrel assembly.

2. Prior Art

Presently rolling door curtains are constructed principally from metal strips hingedly connected together, although they can also be constructed from wood or other materials. Typically, the rolling door curtains are shipped from the manufacturer to the installer in a rolled up bundle. In most instances, there will be cardboard or other protective material between each roll in the bundle to protect the rolling door curtain from being bent or damaged in shippage. The size of the bundle can vary depending upon the size of the rolling door curtain, but, generally, the rolling door curtain is between eight (8) to fifteen (15) feet wide and eight (8) to twenty (20) feet long.

The present practice to install the rolling door curtain is first to unroll the bundle out over a flat surface on the ground, such as a concrete driveway, then attach the rolling door curtain to a barrel assembly, wind the rolling door curtain on the barrel assembly while it is on the ground, and finally to lift the barrel assembly with wound rolling door curtain in position to be permanently attached.

An alternate present practice is to first attach the barrel assembly in position, then unwind and lift the rolling door curtain to the barrel assembly for attachment, and finally wind the rolling door curtain about the barrel assembly.

In either of the present techniques, multiple problems occur, some of which include: damage to the rolling door curtain when it is laid out on the ground, requirement of a large area to wind the rolling door curtain, difficulty in attaching the rolling door curtain to the pre-hung barrel assembly and the time required to attach and position the rolling door curtain.

Some of the disadvantages were overcome by the apparatus disclosed in U.S. Pat. No. 4,153,221, entitled "Rolling Door Curtain Mounting Apparatus" issued to the inventor herein on May 8, 1979. While this apparatus works well for smaller rolling door curtains, difficulty in rolling the curtain onto the barrel still occurs when utilizing the larger curtains.

SUMMARY OF THE INVENTION

Therefore, it is an object of this invention to provide an apparatus and method for mounting a rolling door curtain on a barrel assembly which reduces or eliminates the damage to the rolling door curtain.

Another object of this invention is to provide an apparatus and method for mounting a rolling door curtain on a barrel assembly in a small area.

Still another object of this invention is to provide an apparatus and method for easily mounting a rolling door curtain on a barrel assembly.

A still further object of this invention is to provide an apparatus and method for quickly mounting a rolling door curtain on a barrel assembly.

Other objects and advantages of this invention will become apparent from the ensuing descriptions of the invention.

Accordingly, an apparatus for mounting a rolling door curtain on a barrel assembly having a central axle extending out from the end which will be attached about a door opening for closing same which comprises a movable carrier having adjustable, parallel, spaced apart vertical members, each member having at least one opening aligned with the opening of the other member and being of a diameter sufficiently large to receive the axle, and a drive means attachable to the axle.

In an alternate embodiment, a method for mounting a rolling door curtain onto a barrel assembly is provided comprising the steps of (a) positioning the barrel assembly axle into the aligned openings of the vertical spaced apart member, (b) placing the rolling door curtain onto rotating elements of the spaced apart vertical members, (c) connecting the curtain to the barrel assembly by a line, (d) rotating the barrel assembly by the drive means to draw one end of the curtain up to the barrel assembly, (e) removing the line from the barrel assembly and the curtain, (f) fixedly connecting the curtain end to the barrel assembly, (g) rotating the barrel assembly by the drive means to wrap the curtain about the barrel assembly.

PREFERRED EMBODIMENTS OF THE INVENTION

The rolling door curtain mounting apparatus comprises, in general, movable carriers 1 and 2, each having a vertical support member 3 and 4, respectively, perpendicularly attached to rolling door curtain support brace assemblies 5 and 6, respectively.

Figure 1:
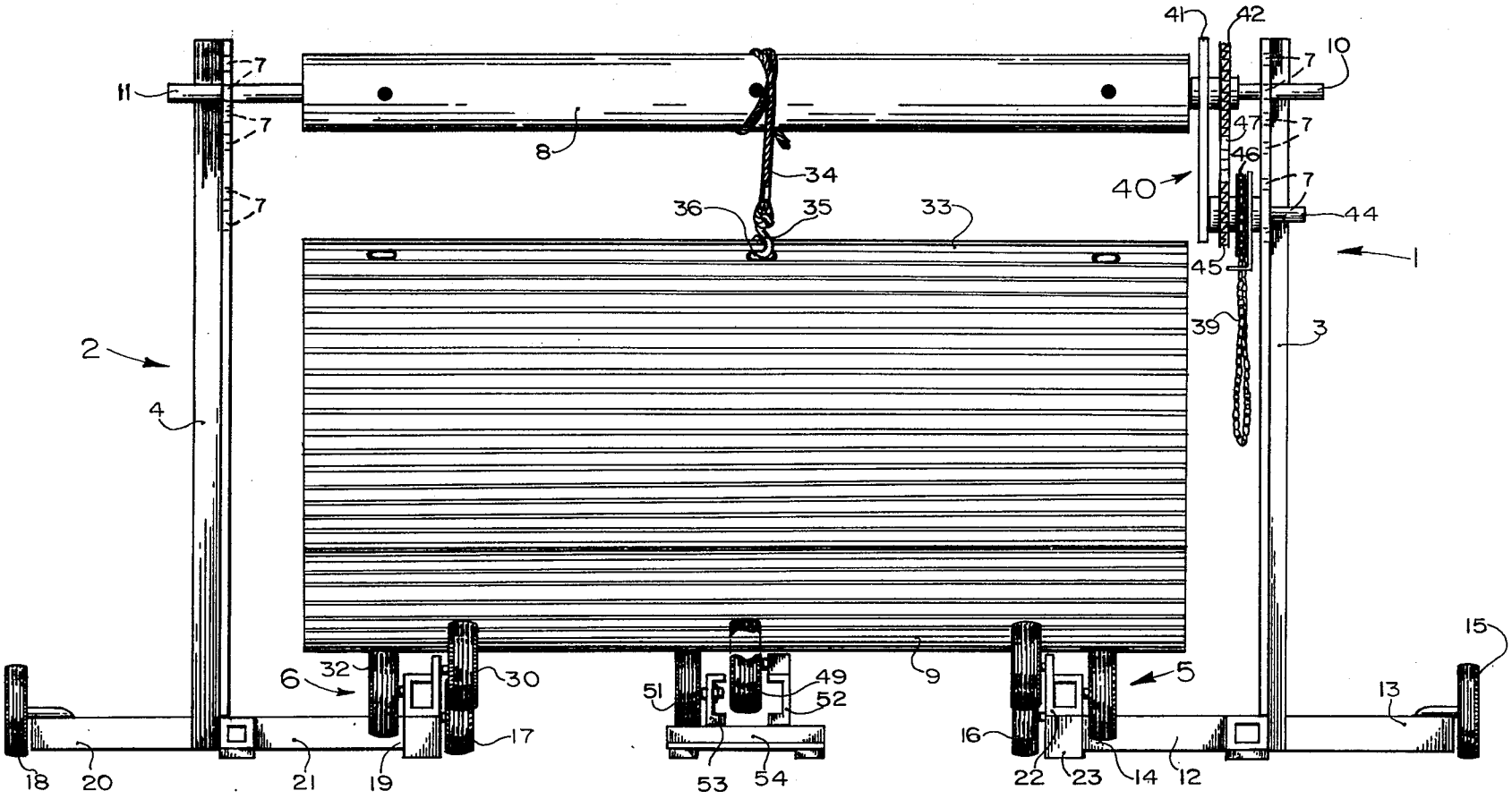
FIG. 1 is a frontal perspective view of one embodiment of this invention having a rolling door curtain mounted thereon.

Each vertical support member 3 and 4 preferably is constructed of angle iron having openings 7 of varying diameters located at the upper end of the support members 3 and 4. Openings 7 in support member 3 are aligned with the openings in support member 4 so that barrel 8 will be parallel with curtain roll 9 when barrel axle ends 10 and 11 are inserted through openings 7 as illustrated in FIG. 1.

Perpendicularly attached at the bottom of vertical support member 3 is cross tubing 12. At either tubing end 13 and 14 are rotatably mounted wheels 15 and 16, respectively, whereby a portion of each wheel 15, 16 extends below cross tubing 12. In similar fashion, wheels 17, 18 are rotatably mounted to ends 19, 20 of cross tubing 21 attached to vertical support member 4.

Rolling door curtain support brace assembly 5 comprises in a preferred embodiment angle iron 22 attached at one end to cross tubing 12. In a more preferred feature, leveling block 23 is attached to the opposite end of angle iron 22 and which has a height the same as cross tubing 12. Rotatably attached to angle iron 22 are wheels 24, 25 and 26. Preferably, wheels 24 and 25 will be spaced apart and level with one another with a portion of each extending above edge 27 of angle iron 22. Wheel 26 will be positioned on the other side of angle iron 22 and slightly below wheels 24 and 25 but with a portion extending above edge 27. Likewise, rolling door curtain support brace assembly 6 comprises angle iron 28 attached at one end to cross tubing 21, leveling block 29 attached to the opposite end, wheels 30, 31 and 32 all assembled together like their counterparts in rolling door curtain support brace assembly 5.

In a preferred feature, a third set of support wheels 49, 50 and 51 are rotatably mounted to channel iron pieces 52 and 53 supported on cross members 54 and 55. Wheels 49 and 50 extend above channel iron pieces 52 and 53 and are parallel to wheels 24, 25, 30 and 31. Similarly, wheel 51 also extends above channel iron pieces 52 and 53 and is parallel to wheels 26 and 32. In this embodiment, additional support is provided curtain roll 9. Additional sets of support wheel assemblies can be used.

Attached to axle 10 is sprocket drive assembly 40 comprising a door headplate 41 and sprocket 42 which are fixedly positioned by key 43. Headplate 41 has a support shaft 44 parallel to axle 10 and positioned below axle 10. Mounted on support shaft 44 is dentil sprocket 45 and pocket chain pulley 46. When chain 39 is pulled, dentil sprocket 45 turns sprocket 42 by roller chain 47, which, in turn, rotates barrel 8.

Figure 2:
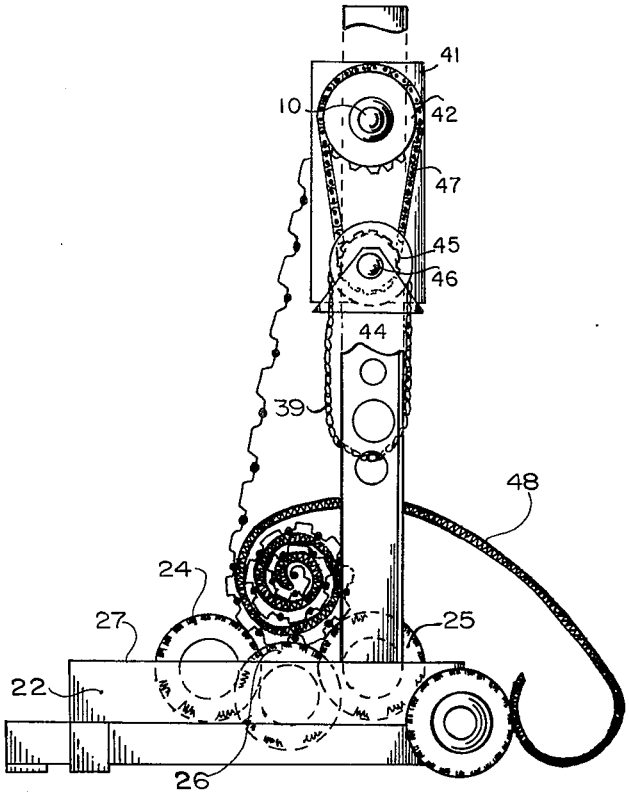
FIG. 2 is a cutaway side view illustrating the separation of the cardboard layer from the rolling curtain door during mounting on the invention.
Figure 4:
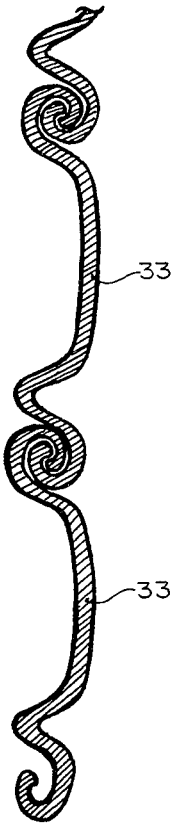
FIG. 4 is a cross-section view of a section of a rolling curtain door.
Figure 5:
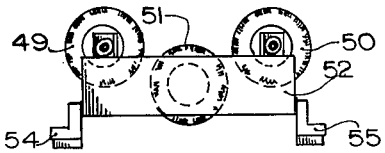
FIG. 5 is a perspective view of the third set of support wheels utilized in this invention.
Figure 3:
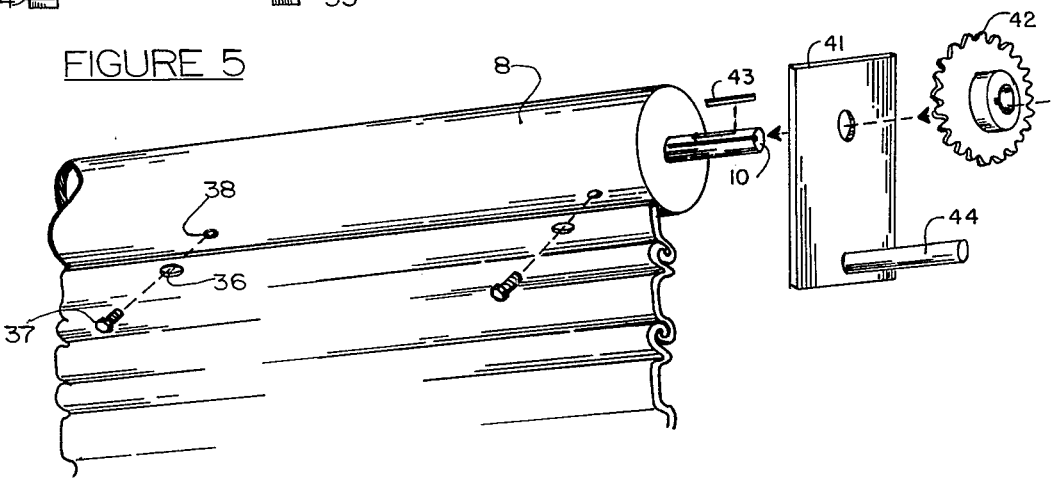
FIG. 3 is an exploded perspective view of one embodiment of this invention illustrating the attachment of the rolling door curtain to the barrel assembly.

FIG. 4 illustrates a typical cross-section of a rolling door curtain 9 which comprises multiple similar sections 33 pivotedly hinged together as shown. In operation, rolling door curtain 9, which is received from the manufacturer in a rolled up form, is placed on wheels 24, 25, 26, 30, 31 and 32 as illustrated in FIG. 1. Next, ropes 34 are attached at one end by S-hooks 35 to curtain openings 36 in one section 33. Ropes 34 are then wrapped around barrel 8 which has been positioned above curtain 9 as shown. Curtain 9 is then lifted up to barrel 8 where it is temporarily secured to angle iron 3 and 4 by vise grips or other similar means. Ropes 34 are then removed and curtain 9 is secured to barrel 8 by screws 37 which pass through curtain openings 36 and into threaded receiving members 38 attached to barrel 8. Finally, rolling door curtain 9 is rolled up on barrel assembly 8 by pulling chain 39. The protective cardboard 48 is pulled between the vertical support members 3 and 4 as shown in FIG. 2. Once rolling door curtain 9 is completely rolled up on barrel assembly 8, it can be hung in position at the building site.

There are, of course, many alternate embodiments, such as use of a motorized drive means, etc., and no limitation is intended by the above description of the preferred embodiments.

What I claim is:

1. An apparatus for mounting a rolling door curtain on a barrel assembly having an axle which will be attached in position about an opening that said door can close, which comprises:

(a) movable carriers having parallel spaced apart vertical members having aligned openings to which said barrel assembly is rotatably attachable;

(b) rolling door curtain support brace assembly attached to each of said movable carriers below a position where said barrel assembly is attached; and (c) drive means for rotating said barrel assembly on said movable carriers, which said drive means is attached to said axle of said barrel assembly, said drive means comprising a head plate and sprocket fixedly attached to said axle, a dentil sprocket support shaft perpendicularly attached to said head plate and parallel to said axle, a dentil sprocket mounted on said support shaft, a pocket chain pulley operatively mounted on said dentil sprocket to rotate said dentil sprocket when pulled, a roller chain operatively attached to said dentil sprocket and said sprocket to cause said sprocket to rotate when said dentil sprocket rotates.

2. An apparatus according to claim 1 also comprising a base member perpendicularly attached to each of said vertical members wherein wheels are rotatably mounted on said base member in supportive position of said base member.

3. An apparatus according to claim 2 wherein said rolling door curtain brace assembly comprises a pair of wheels rotatably attached to each base member at its lower end on which said rolling door curtain rests.

4. An apparatus according to claim 3 wherein a third wheel is rotatably attached to each base member parallel to said pair of wheels, said third wheel positioned between and below said pair of wheels to support said rolling door curtain between and in contact with each of said pair of wheels.

* * * * *